US010337134B2

(12) United States Patent
Yin et al.

(10) Patent No.: US 10,337,134 B2
(45) Date of Patent: Jul. 2, 2019

(54) LAUNDRY DEVICE

(71) Applicant: QINGDAO HAIER SMART TECHNOLOGY R&D CO., LTD., Qingdao (CN)

(72) Inventors: Xiang Yin, Qingdao (CN); Fengling Wu, Qingdao (CN); Qiuqi Mou, Qingdao (CN); Chunfeng Lao, Qingdao (CN); Jiangtao Zhang, Qingdao (CN)

(73) Assignee: QINGDAO HAIER SMART TECHNOLOGY R&D CO., LTD., Qingdao (CN)

( * ) Notice: Subject to any disclaimer, the term of this patent is extended or adjusted under 35 U.S.C. 154(b) by 0 days.

(21) Appl. No.: 16/060,625

(22) PCT Filed: Dec. 27, 2016

(86) PCT No.: PCT/CN2016/112439
§ 371 (c)(1),
(2) Date: Jun. 8, 2018

(87) PCT Pub. No.: WO2017/114394
PCT Pub. Date: Jul. 6, 2017

(65) Prior Publication Data

US 2019/0010653 A1 Jan. 10, 2019

(30) Foreign Application Priority Data

Dec. 28, 2015 (CN) ..... 2015 1 1004283

(51) Int. Cl.
*D06F 37/24* (2006.01)
*D06F 37/12* (2006.01)
(Continued)

(52) U.S. Cl.
CPC ..... *D06F 37/24* (2013.01); *D06F 37/12* (2013.01); *D06F 37/268* (2013.01);
(Continued)

(58) Field of Classification Search
CPC ..... D06F 37/12; D06F 37/24; D06F 37/268; D06F 37/269; D06F 37/30
See application file for complete search history.

(56) References Cited

U.S. PATENT DOCUMENTS 5,907,880 A * 6/1999 Durazzani ..... F16F 9/535 188/267
6,151,930 A * 11/2000 Carlson ..... D06F 37/20 68/12.06
(Continued)

FOREIGN PATENT DOCUMENTS

CN 1071473 A 4/1993
CN 103911810 A 7/2014
(Continued)

OTHER PUBLICATIONS

International Search Report and Written Opinion for corresponding International Application No. PCT/CN2016/112439, dated Apr. 7, 2017, 9 pages.

*Primary Examiner* — Joseph L. Perrin
(74) *Attorney, Agent, or Firm* — Alston & Bird LLP

(57) ABSTRACT

A laundry device comprises an outer tub, an inner tub, an inner magnetic ring and an outer magnetic ring. One of the inner magnetic ring and the outer magnetic ring is directly or indirectly fixed on a bottom wall of the inner tub and positioned at the outer side of the bottom wall of the inner tub, and the other one is directly or indirectly fixed on a bottom wall of the outer tub and positioned at the inner side of the bottom wall of the outer tub. An upper end face and a lower end face of the inner magnetic ring have the same polarity as the upper end face and the lower end face of the
(Continued)

outer magnetic ring so that a radial repulsion between the inner magnetic ring and the outer magnetic ring is used to suppress vibration of the inner tub and/or the outer tub.

10 Claims, 6 Drawing Sheets

(51) Int. Cl.
*D06F 37/26* (2006.01)
*D06F 37/30* (2006.01)
*D06F 39/00* (2006.01)
*D06F 23/04* (2006.01)

(52) U.S. Cl.
CPC ..... *D06F 37/269* (2013.01); *D06F 39/00* (2013.01); *D06F 23/04* (2013.01); *D06F 37/30* (2013.01)

(56) References Cited

U.S. PATENT DOCUMENTS 8,851,247 B2 * 10/2014 Shiga ..... D06F 37/20 188/267
2010/0122881 A1 * 5/2010 Carlson ..... A47C 1/03 188/267
2015/0033804 A1 * 2/2015 Fukui ..... D06F 37/22 68/140
2015/0299928 A1 * 10/2015 Fukui ..... F16C 32/0425 68/3 R
2015/0315736 A1 * 11/2015 Fukui ..... D06F 37/30 68/140
2016/0312394 A1 * 10/2016 Wang ..... D06F 37/22

FOREIGN PATENT DOCUMENTS

CN 104342878 A 2/2015
IT 1275691 B1 10/1997

* cited by examiner

LAUNDRY DEVICE

CROSS-REFERENCE TO RELATED APPLICATIONS

This application is a national phase entry of International Application No. PCT/CN2016/112439, filed Dec. 27, 2016, which claims priority to Chinese Application No. 201511004283.8, filed Dec. 28, 2015, the entire contents of which are incorporated herein by reference.

CROSS-REFERENCE TO RELATED APPLICATIONS

This application is a national phase entry of International Application No. PCT/CN2016/112439, filed Dec. 27, 2016, which claims priority of Chinese Application No. 201511004283.8, filed Dec. 28, 2015, the entire contents of which are incorporated herein by reference.

TECHNICAL FIELD

The present invention relates to a household appliance, in particular to a laundry device.

BACKGROUND OF THE INVENTION

At present, for the common pulsator washing machines in the market, a number of (generally four) suspension rod systems are used to fixedly suspend an outer tub in a housing of the washing machine, and an inner tub is rotatably arranged in the outer tub, in order to reduce the vibration transmitted from the inner and outer tubs to the housing due to eccentric rotation. However, the suspension rod system in the prior art weakens the vibration transmitted from the outer tub to the housing in terms of the vibration transmission path, but cannot reduce the vibration transmitted from the inner tub to the outer tub.

In order to solve the above problem, in the prior art, magnets cooperating with the inner tub and the outer tub and having repulsion magnetic forces are arranged below a bottom wall of the outer tub, so that the inner tub is suspended in the outer tub by means of the repulsion between the magnets. The magnets comprise a first permanent magnet and a second permanent magnet, both of which are located within an outer sleeve below the outer tub. The first permanent magnet is fixedly connected to the inner tub via a connecting shaft, and the second permanent magnet is located below the first permanent magnet and is fixedly connected to the outer tub via the outer sleeve. A segment, between the inner tub and the first permanent magnet, of the connecting shaft needs to sustain the weight of the inner tub and the laundry therein, the repulsion between the first permanent magnet and the second permanent magnet, and the torque of the inner tub when rotating, and therefore this segment of the connecting shaft is prone to fatigue failure, shortening its service life and increasing the maintenance cost of the washing machine.

SUMMARY OF THE INVENTION

At the same time, the inventors of the present application found that the prior art technical solution of suspending the inner tub in the outer tub can only relieve the vibration between the inner tub and the outer tub in the vertical direction (i.e., in the axial direction of the inner and outer tubs). However, the inventors of the present application further recognize that in the case of a pulsator washing machine, during rotation of the inner tub in a horizontal plane about a rotary shaft thereof in the vertical direction, the inner tub easily shakes due to eccentricity and thereby causes the radial vibration. That is to say, the radial vibration of the inner tub and/or the outer tub is one of the most important vibration modes in the pulsator washing machine, which is not recognized by those skilled in the art.

To this end, an object of the present invention is to provide a laundry device that is capable of suppressing the vibration of an inner tub and/or an outer tub in a radial direction, with the aim of overcoming at least one of the drawbacks in the prior art by.

A further object of the present invention is to suppress the vibration of the inner tub and/or the outer tub in an axial direction.

A still further object of the present invention is to reduce the burden on a rotating mechanism of the laundry device and to reduce the cost of maintenance of the laundry device.

In order to achieve the above objects, the present invention provides a laundry device comprising an outer tub, and an inner tub rotatably arranged in the outer tub, the laundry device further comprising:

an inner magnetic ring and an outer magnetic ring, wherein one of the inner magnetic ring and the outer magnetic ring is directly or indirectly fixed to a bottom wall of the inner tub and located on an outer side of the bottom wall of the inner tub, and the other one is directly or indirectly fixed to a bottom wall of the outer tub and located on an inner side of the bottom wall of the outer tub; and an upper end face and a lower end face of the inner magnetic ring respectively have the same polarity as an upper end face and a lower end face of the outer magnetic ring, so as to suppress the vibration of the inner tub and/or the outer tub in a radial direction by means of the radial repulsion between the inner magnetic ring and the outer magnetic ring.

Optionally, the outer magnetic ring is directly or indirectly fixed to the bottom wall of the inner tub and located on the outer side of the bottom wall of the inner tub, and the inner magnetic ring is directly or indirectly fixed to the bottom wall of the outer tub and located on the inner side of the bottom wall of the outer tub.

Optionally, the outer magnetic ring is configured to be movable in a vertical direction with respect to the inner magnetic ring, so as to increase the area of regions, having the same magnetism and overlapping in the vertical direction, of the inner magnetic ring and the outer magnetic ring.

Optionally, the laundry device further comprises:

an upper magnetic ring, which is directly or indirectly fixed to the bottom wall of the inner tub and located on the outer side of the bottom wall of the inner tub, wherein the upper magnetic ring is opposed to the inner magnetic ring in the vertical direction, and a lower surface of the upper magnetic ring has the same polarity as an upper surface of the inner magnetic ring, so as to support the inner tub in the outer tub in a suspended manner by means of the repulsion between the inner magnetic ring and the upper magnetic ring, and to make the forces of gravity of the inner tub and contents therein directly act on the bottom wall of the outer tub via the inner magnetic ring and the upper magnetic ring.

Optionally, the laundry device further comprises:

a flange plate fixed to the bottom wall of the inner tub on the outer side of the bottom wall of the inner tub; and a magnetic floating sleeve fixed to the flange plate on a lower side, facing the bottom wall of the outer tub, of the flange plate, wherein the outer magnetic ring and the upper magnetic ring are both arranged in the magnetic floating sleeve so as to be indirectly fixed to the bottom wall of the inner tub via the magnetic floating sleeve and the flange plate.

Optionally, the magnetic floating sleeve is a cylindrical body having a bottom opening; and the upper magnetic ring is arranged at a top wall of the magnetic floating sleeve, and the outer magnetic ring is arranged at a peripheral wall of the magnetic floating sleeve and is located below the upper magnetic ring.

Optionally, the laundry device further comprises:

a rotating mechanism arranged below the bottom wall of the outer tub, the rotating mechanism having a rotary mandrel extending from below the outer tub into the inner tub to drive the rotation of a pulsator arranged in the inner tub, and a rotary sleeve fitted over the outer side of the rotary mandrel to drive the rotation of the inner tub, wherein the top wall of the magnetic floating sleeve and the flange plate each has a through-hole through which the rotary sleeve can pass, and the through-hole of the top wall of the magnetic floating sleeve is vertically opposed to the through-hole of the flange plate.

Optionally, the inner magnetic ring and the upper magnetic ring each has a central circular hole penetrating in an axial direction thereof; and the inner magnetic ring surrounds a central axial hole of the bottom wall of the outer tub, and the upper magnetic ring surrounds the through-hole of the top wall of the magnetic floating sleeve.

Optionally, the thickness of the inner magnetic ring in the vertical direction is greater than the thickness of the outer magnetic ring in the vertical direction.

Optionally, the inner magnetic ring has an inner diameter and an outer diameter that are respectively the same as those of the upper magnetic ring so that projections of the inner magnetic ring and the upper magnetic ring coincide with each other in a horizontal plane.

Optionally, the outer magnetic ring is arranged opposite the inner magnetic ring on the radially outer side of the inner magnetic ring.

Optionally, at least a portion of the inner magnetic ring is located within a central circular hole of the outer magnetic ring.

Since the laundry device of the present invention comprises an inner magnetic ring and an outer magnetic ring arranged on the bottom wall of the inner tub and the bottom wall of the outer tub thereof, and the upper end face and the lower end face of the inner magnetic ring respectively have the same polarity as the upper end face and the lower end face of the outer magnetic ring, the magnetisms between adjacent surfaces, which are at least partially opposed, of the inner magnetic ring and the outer magnetic ring are the same, and the radial magnetic repulsion between the inner magnetic ring and the outer magnetic ring may be generated. When there is a radial relative movement between the inner tub and the outer tub, the inner magnetic ring and the outer magnetic ring can function as a buffer, so as to suppress the radial vibration of the inner tub and/or the outer tub to a great extent, thereby preventing the vibration from being transmitted from the outer tub to the housing of the laundry device, weakening the overall radial vibration of the laundry device during washing and spin-drying, and reducing noise.

Further, since the laundry device of the present invention further comprises an upper magnetic ring arranged at the bottom wall of the inner tub and opposite the inner magnetic ring, and the lower surface of the upper magnetic ring has the same polarity as the upper surface of the inner magnetic ring, the inner tub can be supported in the outer tub in a suspended manner by means of the magnetic repulsion between the upper magnetic ring and the inner magnetic ring, reducing the mechanical contact between the inner tub and the outer tub. When there is an axial relative movement between the inner tub and the outer tub, the upper magnetic ring and the inner magnetic ring can function as a buffer, so as to suppress the axial vibration of the inner tub and/or the outer tub to a great extent, thereby reducing noise. It can be seen therefrom that the present invention can reduce the vibrations of the inner tub and/or the outer tub in both the axial and radial directions by the combination of the upper magnetic ring, the inner magnetic ring and the outer magnetic ring, reducing the noise generated during the operation of the laundry device.

Further, the laundry device of the present invention can utilize the magnetic repulsion between the upper magnetic ring and the inner magnetic ring to allow the forces of gravity of the inner tub and the contents therein to be directly applied to the bottom wall of the outer tub, thereby reducing the forces applied to the rotary sleeve for connecting the inner tub and the rotating mechanism, which can prevent fatigue failure of the rotary sleeve and prolong the service life of thereof so as to reduce the cost of the laundry device on the one hand; and on the other hand, can also reduce the force applied to the rotating mechanism via the rotary sleeve, i.e., reducing the burden on the rotating mechanism to prevent the occurrence of damage thereto, and reducing the cost of maintenance of the laundry device.

The foregoing and other objects, advantages and features of the present invention will become more apparent to those skilled in the art from the following detailed description of specific embodiments of the present invention taken in conjunction with the accompanying drawings.

BRIEF DESCRIPTION OF THE DRAWINGS

Some specific embodiments of the present invention will be described in detail by way of example only rather than by way of limitation with reference to the accompanying drawings. The same reference numerals in the accompanying drawings denote the same or similar components or parts. It should be understood by those skilled in the art that these drawings are not necessarily to scale. In the accompanying drawings.

DETAILED DESCRIPTION OF THE INVENTION

Figure 1:
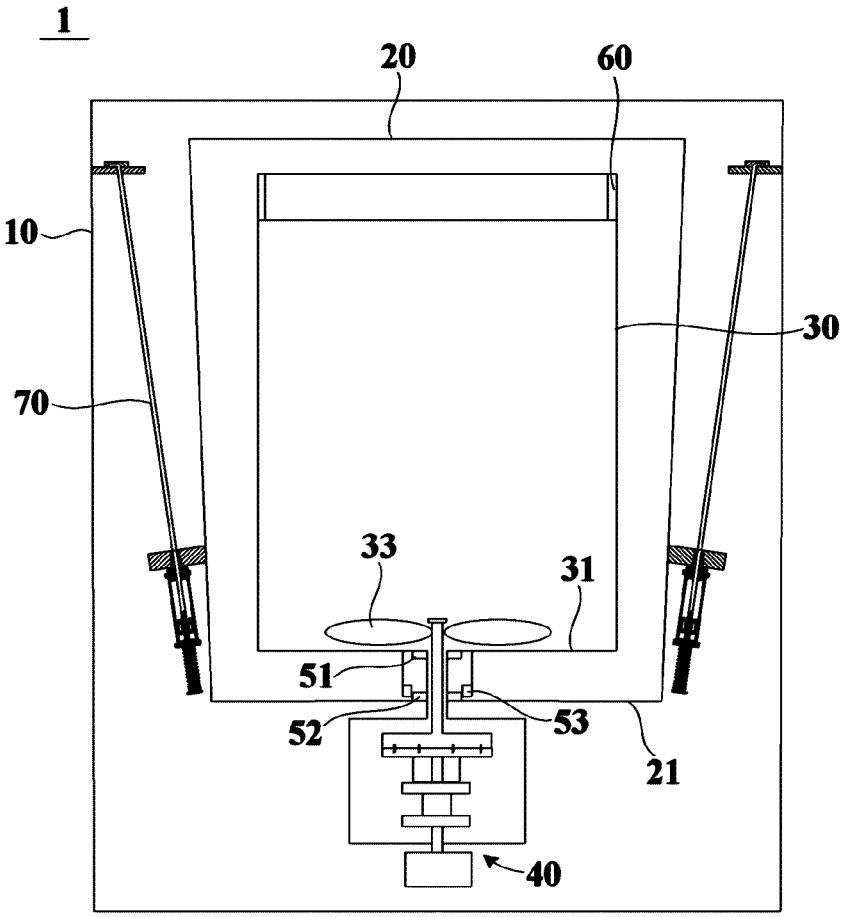
FIG. 1 is a schematic structural diagram of a laundry device according to an embodiment of the present invention.

FIG. 1 is a schematic structural diagram of a laundry device 1 according to an embodiment of the present invention. The laundry device 1 may comprise an outer tub 20, and an inner tub 30 rotatably arranged in the outer tub 20. Further, the laundry device 1 further comprises a housing 10 forming the overall appearance of the laundry device, a plurality of damping suspension rods 70 for suspending the outer tub 20 in the housing 10, and a balancing ring 60 arranged at the top of the inner tub 30 to weaken the vibration of the inner tub 30. The laundry device 1 may be a radial rotating laundry device with the inner tub 30 thereof being rotated in a horizontal plane about a rotary shaft extending in the vertical direction. In particular, the laundry device 1 may be a pulsator washing machine, and a pulsator 33 for agitating the laundry in the washing process is arranged in the inner tub 30.

Figure 2:
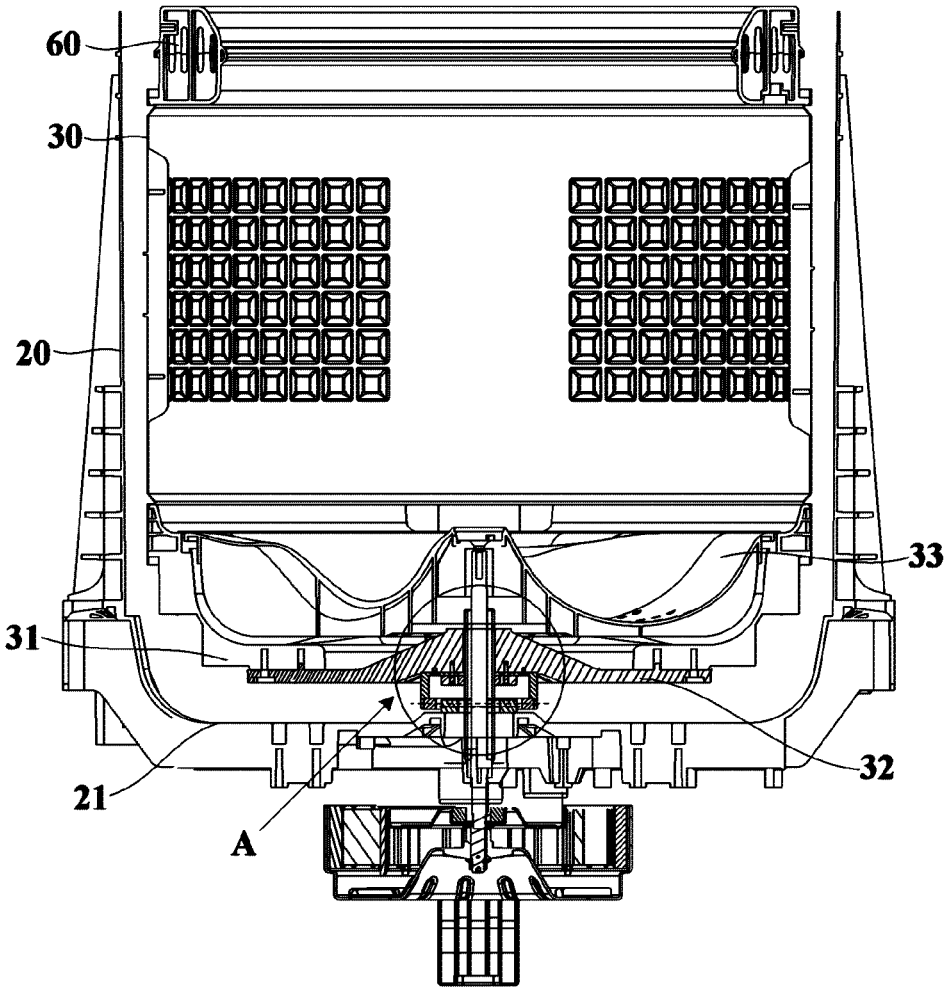
FIG. 2 is a schematic sectional diagram of a laundry device in an idle state according to an embodiment of the present invention.
Figure 3:
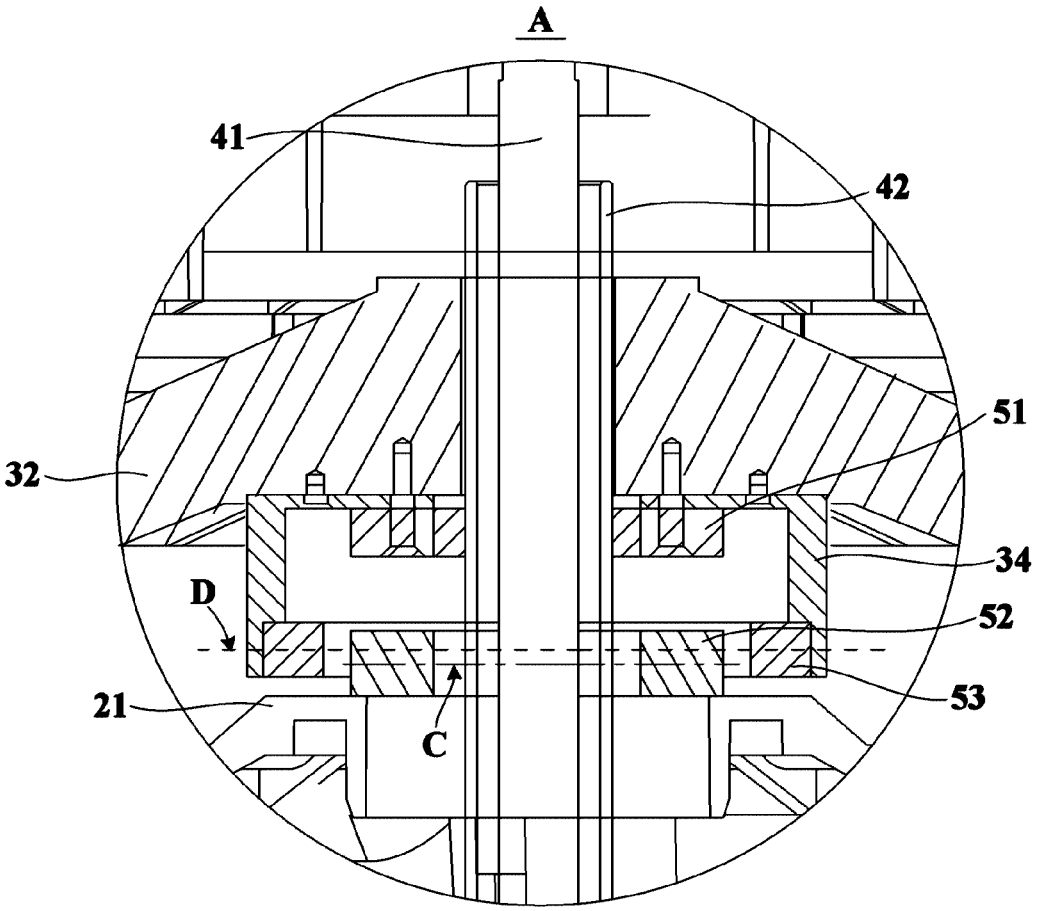
FIG. 3 is a schematic enlarged diagram of part A in FIG. 2.

FIG. 2 is a schematic sectional diagram of a laundry device 1 in an idle state according to an embodiment of the present invention; and FIG. 3 is a schematic enlarged diagram of part A in FIG. 2. Referring to FIGS. 2 and 3, the laundry device 1 further comprises an inner magnetic ring 52 and an outer magnetic ring 53. One of the inner magnetic ring 52 and the outer magnetic ring 53 is directly or indirectly fixed to a bottom wall 31 of the inner tub 30 and located on an outer side of the bottom wall 31 of the inner tub, and the other one is directly or indirectly fixed to a bottom wall 21 of the outer tub 20 and located on an inner side of the bottom wall 21 of the outer tub. That is to say, the inner magnetic ring 52 and the outer magnetic ring 53 are respectively fixed on the bottom walls of different tubs of the inner and outer tubs, and are located between the bottom wall 31 of the inner tub and the bottom wall 21 of the outer tub. For example, in some embodiments of the present invention, the inner magnetic ring 52 may be fixed to the bottom wall 31 of the inner tub on the outer side of the bottom wall 31 of the inner tub, and the outer magnetic ring 53 may be fixed to the bottom wall 21 of the outer tub on the inner side of the bottom wall 21 of the outer tub. In other embodiments of the present invention, the inner magnetic ring 52 may be fixed to the bottom wall 21 of the outer tub on the inner side of the bottom wall 21 of the outer tub, and the outer magnetic ring 53 may be fixed to the bottom wall 31 of the inner tub on the outer side of the bottom wall 31 of the inner tub.

As shown, those skilled in the art will appreciate that the inner magnetic ring 52 and the outer magnetic ring 53 herein are relative. Specifically, the outer magnetic ring 52 is arranged opposite the inner magnetic ring 53 on the radially outer side of the inner magnetic ring 53, and the inner magnetic ring 53 is arranged opposite the outer magnetic ring 52 on the radially inner side of the outer magnetic ring 52.

Further, an upper end face and a lower end face of the inner magnetic ring 52 respectively have the same polarity as an upper end face and a lower end face of the outer magnetic ring 53, so as to suppress the vibration of the inner tub 30 and/or the outer tub 20 in the radial direction by means of the radial repulsion between the inner magnetic ring 52 and the outer magnetic ring 53. That is to say, the polarities of the upper end face of the inner magnetic ring 52 and the upper end face of the outer magnetic ring 53 are the same (both of which may be N pole or S pole of their own magnetic ring), and the polarities of the lower end face of the inner magnetic ring 52 and the lower end face of the outer magnetic ring 53 are the same (both of which may be S pole or N pole of their own magnetic ring). In this way, the upper half of the inner magnetic ring 52 and the upper half of the outer magnetic ring 53 may exhibit the same magnetism, and the lower half of the inner magnetic ring 52 and the lower half of the outer magnetic ring 53 may exhibit the same magnetism. When at least a portion of the inner magnetic ring 52 is located within a central circular hole of the outer magnetic ring 53, the magnetisms between adjacent surfaces, which are at least partially opposed, of the inner magnetic ring 52 and the outer magnetic ring 53 are the same, and the radial magnetic repulsion between the inner magnetic ring 52 and the outer magnetic ring 53 may be generated. When there is a radial relative movement between the inner tub 30 and the outer tub 20, the inner magnetic ring 52 and the outer magnetic ring 53 can function as a buffer, so as to suppress the radial vibration of the inner tub 30 and/or the outer tub 20 to a great extent, thereby preventing the vibration from being transmitted from the outer tub 20 to the housing 10 of the laundry device 1, weakening the overall radial vibration of the laundry device 1 during washing and spin-drying, and reducing noise.

In some embodiments of the present invention, the outer magnetic ring 53 may be directly or indirectly fixed to the bottom wall 31 of the inner tub and located on the outer side of the bottom wall 31 of the inner tub, and the inner magnetic ring 52 may be directly or indirectly fixed to the bottom wall 21 of the outer tub and located on the inner side of the bottom wall 21 of the outer tub.

Further, the outer magnetic ring 53 is configured to be movable in the vertical direction with respect to the inner magnetic ring 52, so as to increase the area of regions, having the same magnetism and overlapping in the vertical direction, of the inner magnetic ring 52 and the outer magnetic ring 53. It is to be understood by those skilled in the art that the regions, overlapping in the vertical direction, of the inner magnetic ring 52 and the outer magnetic ring 53 in the embodiment of the present invention refer to adjacent surface regions, opposite each other, of the inner magnetic ring 52 and the outer magnetic ring 53. When the laundry is contained in the inner tub 30, the inner tub 30 is subjected to the force of gravity of the laundry contained therein, and the position of the bottom wall 31 of the inner tub with respect to the bottom wall 21 of the outer tub may be slightly lowered to allow the outer magnetic ring 53 to move relative to the inner magnetic ring 52 in the vertical direction. During the washing or spin-drying and other operations of the laundry device 1, an axial vibration may occur between the inner tub 30 and the outer tub 20, and a relative displacement may be generated in the vertical direction between the bottom wall 31 of the inner tub and the bottom wall 21 of the outer tub, so that the outer magnetic ring 53 can move relative to the inner magnetic ring 52 in the vertical direction.

Referring to FIGS. 2 and 3, when the laundry device 1 is in an idle state, no laundry is contained in the inner tub 30, and the laundry device 1 is not in operation. In this state, at least part of the inner magnetic ring 52 extends into the central circular hole of the outer magnetic ring 53, and a horizontal centerline C for bisecting the inner magnetic ring 52 in the vertical direction is lower than a horizontal centerline D for bisecting the outer magnetic ring 53 in the vertical direction. That is to say, the horizontal centerline C of the inner magnetic ring 52 is capable of equally dividing the inner magnetic ring 52 into the upper half and the lower half, the horizontal centerline D of the outer magnetic ring 53 is capable of equally dividing the outer magnetic ring 53 into the upper half and the lower half, and the height of the horizontal centerline C in the vertical direction is lower than the height of the horizontal centerline D in the vertical direction. The regions, having the same magnetism and overlapping in the vertical direction, of the inner magnetic ring 52 and the outer magnetic ring 53 comprise an inner circumferential face of the inner magnetic ring 52 above the horizontal centerline C of the outer magnetic ring 53 and an inner circumferential face located below the horizontal centerline D of the inner magnetic ring 52 and extending into the central circular hole of the outer ring 53.

Figure 4:
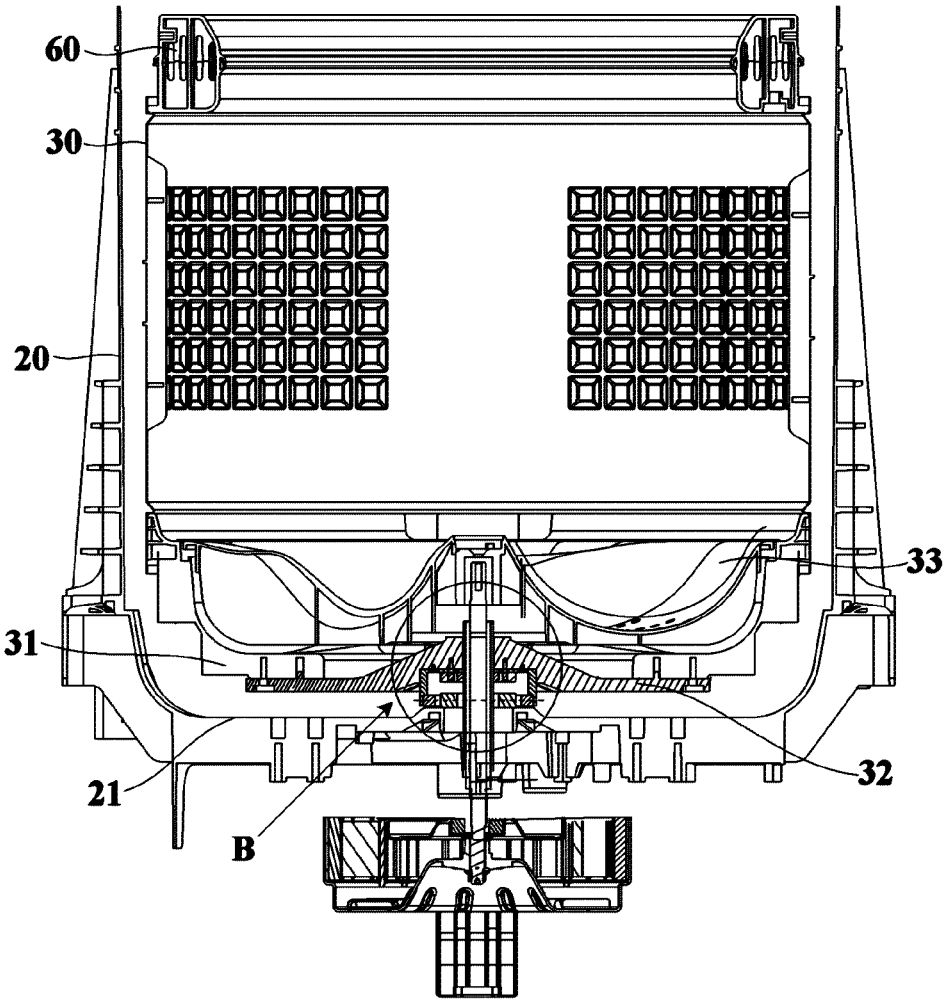
FIG. 4 is a schematic sectional diagram of a laundry device in an operation state according to an embodiment of the present invention.
Figure 5:
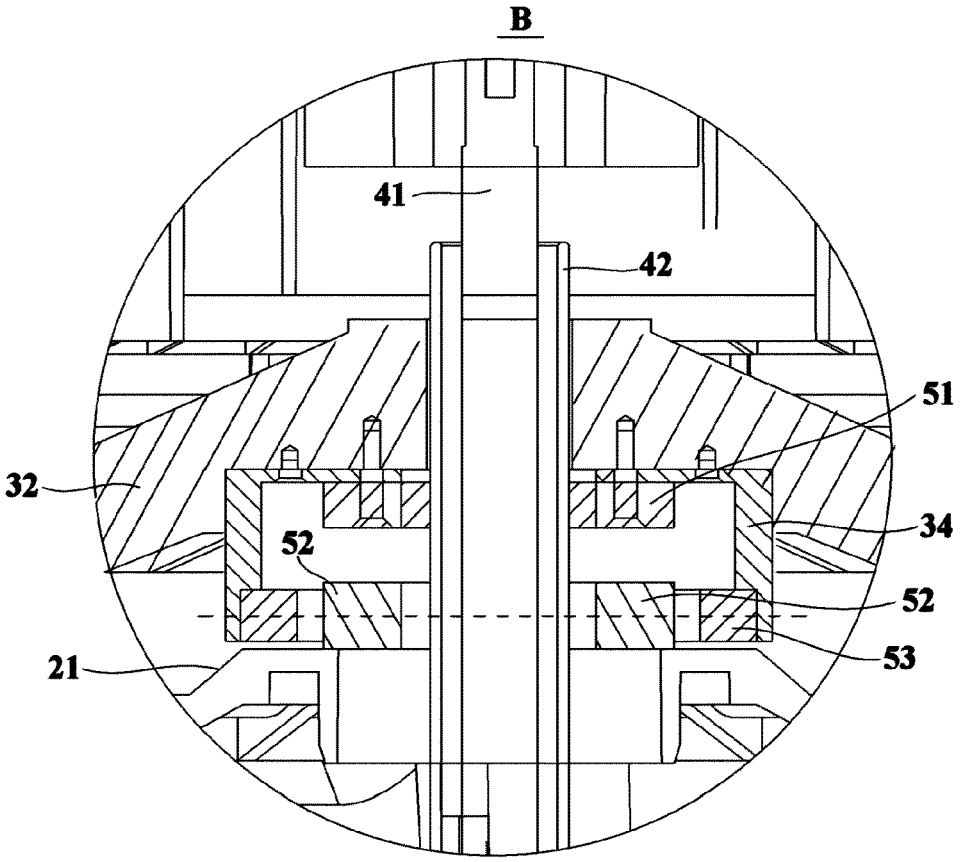
FIG. 5 is a schematic enlarged diagram of part B in FIG. 4.

FIG. 4 is a schematic sectional diagram of a laundry device in an operation state according to an embodiment of the present invention; and FIG. 5 is a schematic enlarged diagram of part B in FIG. 4. Referring to FIGS. 4 and 5, when the laundry device is in a washing, spin-drying or other operation state, the laundry is contained in the inner tub 30, and an axial vibration may occur between the inner tub 30 and the outer tub 20. In this state, there may be a vertical relative motion between the inner tub 30 and the outer tub 20, that is to say, the position of the bottom wall 31 of the inner tub relative to the bottom wall 21 of the outer tub may decrease, causing the area, extending into the central circular hole of the outer magnetic ring 53, of the inner magnetic ring 52 increases, so that the height difference between the horizontal centerline C of the inner magnetic ring 52 and the horizontal centerline D of the outer magnetic ring 53 is reduced to within 1 mm. In some embodiments of the present invention, it is preferable that the horizontal centerline C of the inner magnetic ring 52 is substantially flush with the horizontal centerline D of the outer magnetic ring 53. When the thickness of the inner magnetic ring 52 in the vertical direction is equal to or greater than the thickness of the outer magnetic ring 53 in the vertical direction, the regions, having the same magnetism and overlapping in the vertical direction, of the inner magnetic ring 52 and the outer magnetic ring 53 comprise the entire inner circumferential face of the outer magnetic ring 53; and when the thickness of the inner magnetic ring 52 in the vertical direction is less than the thickness of the outer magnetic ring 53 in the vertical direction, the regions, having the same magnetism and overlapping in the vertical direction, of the inner magnetic ring 52 and the outer magnetic ring 53 comprise the entire outer circumferential face of the inner magnetic ring 52. At this time, the regions, having the same magnetism and overlapping in the vertical direction, of the inner magnetic ring 52 and the outer magnetic ring 53 have the largest area, and the radial repulsion between the inner magnetic ring 52 and the outer magnetic ring 53 becomes the strongest, so that the radial vibration of the inner tub 30 and/or the outer tub 20 can be better suppressed.

In some embodiments of the present invention, the laundry device 1 further comprises an upper magnetic ring 51, which is directly or indirectly fixed to the bottom wall 31 of the inner tub 30 and located on the outer side of the bottom wall 31 of the inner tub. The upper magnetic ring 51 is opposed to the inner magnetic ring 52 in the vertical direction, and a lower surface of the upper magnetic ring 51 has the same polarity as an upper surface of the inner magnetic ring 52, so as to support the inner tub 30 in the outer tub 20 in a suspended manner by means of the repulsion between the inner magnetic ring 52 and the upper magnetic ring 51, and to make the forces of gravity of the inner tub 30 and contents therein directly act on the bottom wall 21 of the outer tub 20 via the inner magnetic ring 52 and the upper magnetic ring 51. In this way, the inner tub 30 can be supported in the outer tub 20 in a suspended manner by means of the repulsion between the upper magnetic ring 51 and the inner magnetic ring 52, reducing the mechanical contact between the inner tub 30 and the outer tub 20. When there is an axial relative movement between the inner tub 30 and the outer tub 20, the upper magnetic ring 51 and the inner magnetic ring 52 can function as a buffer, so as to suppress the axial vibration of the inner tub 30 and/or the outer tub 20 to a great extent, thereby reducing noise. It can be seen therefrom that the present invention can reduce the vibrations of the inner tub 30 and/or the outer tub 20 in both the axial and radial directions by the combination of the upper magnetic ring 51, the inner magnetic ring 52 and the outer magnetic ring 53, reducing the noise generated during the operation of the laundry device 1, the structure thereof being simple.

Specifically, the upper magnetic ring 51 has an inner diameter and an outer diameter that are respectively the same as those of the inner magnetic ring 52 so that projections of the upper magnetic ring 51 and the inner magnetic ring 52 coincide with each other in a horizontal plane. That is to say, the upper magnetic ring 51 and the inner magnetic ring 52 may be directly opposed to each other in the vertical direction. In this way, there is only the repulsion between the upper magnetic ring 51 and the inner magnetic ring 52 in the vertical direction, to make the suspension of the inner tub 30 more stable. Further, the thickness of the inner magnetic ring 52 in the vertical direction may be slightly larger than the thickness of the outer magnetic ring 53 in the vertical direction, whereby when the horizontal centerline C of the inner magnetic ring 52 is approximately flush with the horizontal centerline D of the outer magnetic ring 53, a clearance is still left between the lower end face of the outer magnetic ring 53 and the inner surface of the bottom wall 21 of the outer tub to prevent the inner tub 30 from coming into contact with the outer magnetic ring 53 during rotating to generate friction.

The inventors of the present application found through a large number of specific experiments that when the thicknesses of the inner magnetic ring 52 and the outer magnetic ring 53 are selected to enable the height difference between the horizontal centerline C of the inner magnetic ring 52 and the horizontal centerline D of the outer magnetic ring 53 to be controlled within 1 mm in the washing and spin-drying processes of the laundry device 1, sufficient repulsion can be generated between the inner and outer magnetic rings to suppress the radial vibration of the inner tub 30 and the outer tub 20 to obtain a better vibration and noise reduction effects. In particular, when the thicknesses of the inner magnetic ring 52 and the outer magnetic ring 53 are selected to enable the horizontal centerline C of the inner magnetic ring 52 to be flush with the horizontal centerline D of the outer magnetic ring 53 in the washing and spin-drying processes of the laundry device 1, the best vibration and noise reduction effects are obtained.

In some embodiments of the present invention, the laundry device 1 further comprises a flange plate 32 and a magnetic floating sleeve 34. The flange plate 32 is fixed to the bottom wall 31 of the inner tub on the outer side the bottom wall of the inner tub 30, that is to say, the flange plate 32 is fixed to the bottom wall 31 of the inner tub and located on the outer side of the bottom wall 31 of the inner tub. The magnetic floating sleeve 34 is fixed to the flange plate 32 on the lower side, facing the bottom wall 21 of the outer tub, of the flange plate 32, that is to say, the magnetic floating sleeve 34 is fixed to the flange plate 32 and located on the lower side of the flange plate 32. Specifically, the flange plate 32 may be fixed to the bottom wall 31 of the inner tub via screws, and the magnetic floating sleeve 3 may be fixed to the flange plate 32 via screws. Further, the outer magnetic ring 53 and the upper magnetic ring 51 are both arranged in the magnetic floating sleeve 34 so as to be indirectly fixed to the bottom wall 31 of the inner tub via the magnetic floating sleeve 34 and the flange plate 32, so that the structure is simple and the assembly is easy.

Further, the magnetic floating sleeve 34 is a cylindrical body having a bottom opening. The upper magnetic ring 51 is arranged at a top wall of the magnetic floating sleeve 34, and the outer magnetic ring 53 is arranged at a peripheral wall of the magnetic floating sleeve 34 and is located below the upper magnetic ring 51. Specifically, the outer magnetic ring 53 may be adjacent to the bottom opening of the magnetic floating sleeve 34, and the lower end face of the outer magnetic ring 53 may be flush with the bottom opening of the magnetic floating sleeve 34. The lower end face of the upper magnetic ring 51 is vertically spaced apart from the upper end face of the outer magnetic ring 53 so as to allow the inner magnetic ring 52 to extend into the outer magnetic ring 53, with the horizontal centerlines of the two being flush with each other.

In some embodiments of the present invention, the laundry device 1 further comprises a rotating mechanism 40 arranged below the bottom wall 21 of the outer tub 20. Referring to FIGS. 3 and 5, the rotating mechanism 40 has a rotary mandrel 41 extending from below the outer tub 20 into the inner tub 30 to drive the rotation of the pulsator 33 arranged in the inner tub 30, and a rotary sleeve 42 fitted over the outer side of the rotary mandrel 41 to drive the rotation of the inner tub 30. Specifically, the rotary mandrel 41 may pass through the bottom wall 21 of the outer tub and the bottom wall 31 of the inner tub from below the outer tub 20 and is directly connected to the pulsator 33 in a form-fitting manner via a spline or other structure. The rotary sleeve 42 extends upward from below the outer tub 20 to the bottom wall 31 of the inner tub 30 or close to the bottom wall 31 of the inner tub 30, to directly or indirectly drive the inner tub 30 to rotate. The rotary sleeve 42 is an internally hollow connecting shaft into which the rotary mandrel 41 is inserted. The height by which the rotary sleeve 42 extends upwardly is lower than the height by which the rotary mandrel 41 extends upwardly, so as to expose a portion of the upper part of the rotary mandrel 41 to the outside of the rotary sleeve 42 to facilitate connection of the rotary mandrel 41 with the pulsator 33. The rotary sleeve 42 may extend to the bottom wall 31 of the inner tub 30 for direct connection with the bottom wall 31 of the inner tub in a form-fitting manner, to directly drive the inner tub 30 to rotate. Alternatively, the rotary sleeve 42 may extend close to the bottom wall 31 of the inner tub and is connected, in a form-fitting manner, to the flange plate 32 which is fixed to the outer side of the bottom wall 31 of the inner tub, to indirectly drive the inner tub 30 to rotate via the flange plate 32.

It can be seen from the above description that the gravity of the inner tub 30, the gravity of the laundry contained in the inner tub 30, and the repulsion between the upper magnetic ring 51 and the inner magnetic ring 52 can be directly applied to the bottom wall 21 of the outer tub 20, thereby preventing the acting forces from being applied to the rotary sleeve 42, which can prevent fatigue failure of the rotary sleeve 42 and prolong the service life of thereof; and on the other hand, can also reduce the force applied to the rotating mechanism 40 via the rotary sleeve 42, i.e., reducing the burden on the rotating mechanism 40 to prevent the occurrence of damage thereto, and reducing the cost of maintenance of the laundry device.

Figure 6:
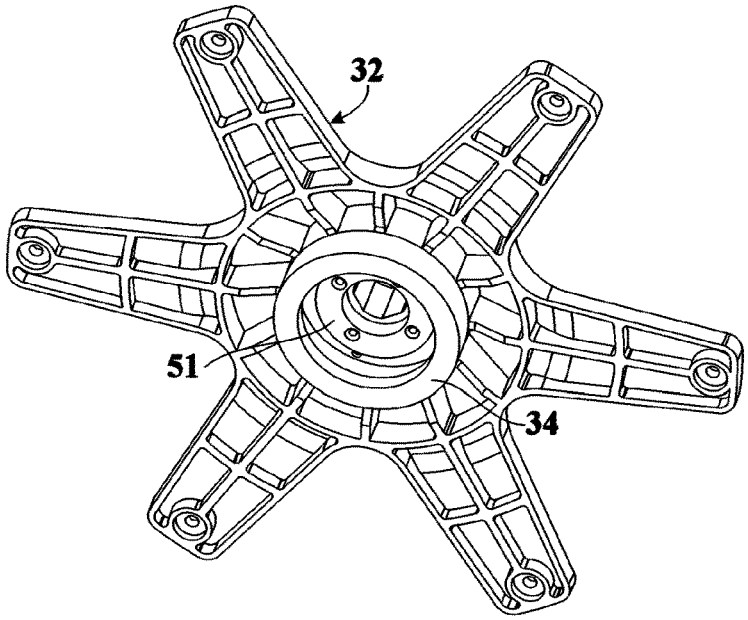
FIG. 6 is a schematic structural diagram of a flange plate and a magnetic floating sleeve of a laundry device according to an embodiment of the present invention.
Figure 7:
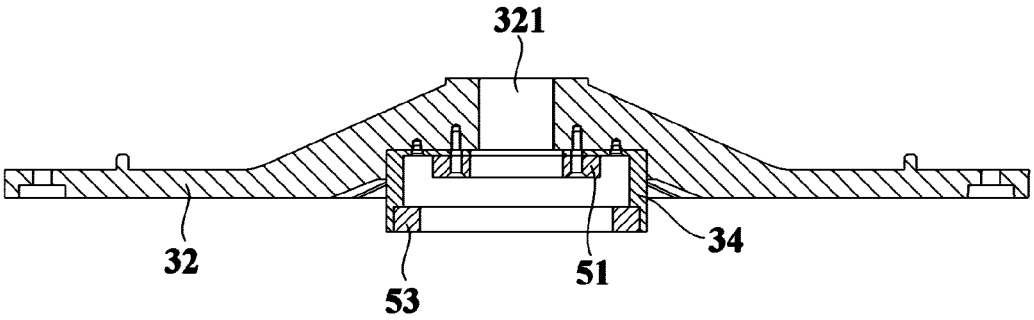
FIG. 7 is a schematic sectional diagram of a flange plate and a magnetic floating sleeve of a laundry device according to an embodiment of the present invention.

FIG. 6 is a schematic structural diagram of a flange plate 32 and a magnetic floating sleeve 34 of a laundry device 1 according to an embodiment of the present invention; and FIG. 7 is a schematic sectional diagram of a flange plate 32 and a magnetic floating sleeve 34 according to an embodiment of the present invention. The upper magnetic ring 51 is also shown in FIG. 6, and the upper magnetic ring 51 and the outer magnetic ring 53 are also shown in FIG. 7. Further, the top wall of the magnetic floating sleeve 34 and the flange plate 32 each has a through-hole through which the rotary sleeve 42 can pass, and the through-hole of the top wall of the magnetic floating sleeve 34 is vertically opposed to the through-hole 321 of the flange plate 32 for the rotary sleeve 42 to pass through. The inner magnetic ring 52 and the upper magnetic ring 51 each has a central circular hole penetrating in an axial direction thereof, the inner magnetic ring 52 surrounds a central axial hole of the bottom wall 21 of the outer tub, and the upper magnetic ring 51 surrounds the through-hole of the top wall of the magnetic floating sleeve 34. That is to say, the upper magnetic ring 51, the inner magnetic ring 52 and the outer magnetic ring 53 each is arranged at a central position between the bottom wall of the inner tub 30 and the bottom wall of the outer tub 20, so that the axial repulsion generated between the upper magnetic ring 51 and the inner magnetic ring 52, and the radial repulsion generated between the inner magnetic ring 52 and the outer magnetic ring 53 each acts on the inner tub 30 and the outer tub 20 more evenly to prevent the inner tub 30 from tilting.

In some embodiments of the present invention, the inner magnetic ring 52 protrudes from the inner surface of the bottom wall 21 of the outer tub such that at least a portion of the inner magnetic ring 52 extends into the central circular through-hole of the outer magnetic ring 53, and the occurrence of contact between the outer magnetic ring 53 and the bottom wall 21 of the outer tub is prevented.

In some embodiments of the present invention, the outer magnetic ring 53, the inner magnetic ring 52 and the upper magnetic ring 51 each may be a permanent magnetic ring. In some embodiments of the present invention, the outer magnetic ring 53 may be a circular ring-shaped, one-piece member. In other embodiments of the present invention, the outer magnetic ring 53 may also be an annular magnet formed by enclosing a plurality of individual magnetic components, the upper end faces and the lower end faces of the plurality of magnetic components being flush with each other. The inner magnetic ring 52 and the upper magnetic ring 51 may also respectively be a one-piece member, or an annular magnet formed by enclosing a plurality of individual magnetic components.

It is to be understood by those skilled in the art that the laundry device 1 according to the present invention comprises, but is not limited to, a washing machine only having a washing and spin-drying function, and further comprises laundry apparatuses having other functions, such as a washing and drying machine with a washing and spin-drying function and a drying function.

It is also to be understood by those skilled in the art that in the description of the present invention, the terms "upper", "lower", "inside", "outside", "top", "bottom", "vertical", "horizontal", etc. for indicating the orientation or positional relationships are based on the actual usage state of the laundry device, and these terms are merely for convenience in describing and understanding the technical solutions of the present invention, rather than indicating or implying that the apparatus or components referred to must have a particular orientation or be constructed and operated in a particular orientation, and therefore will not be interpreted as limiting the present invention.

At this point, those skilled in the art will recognize that, while numerous exemplary embodiments of the present invention have been shown and described in detail herein, many other variations or modifications that conform to the principles of the present invention may be determined or derived directly from the disclosure of the present invention without departing from the spirit and scope of the present invention. It therefore should be understood and determined that the scope of the present invention covers all such other modifications or modifications.

What is claimed is:

1. A laundry device comprising an outer tub, and an inner tub rotatably arranged in the outer tub, the laundry device further comprising:

an inner magnetic ring and an outer magnetic ring, wherein the outer magnetic ring is indirectly fixed to a bottom wall of the inner tub and located on an outer side of the bottom wall of the inner tub, and the inner magnetic ring is directly or indirectly fixed to a bottom wall of the outer tub and located on an inner side of the bottom wall of the outer tub; and an upper end face and a lower end face of the inner magnetic ring respectively have the same polarity as an upper end face and a lower end face of the outer magnetic ring, so as to suppress the vibration of the inner tub and/or the outer tub in a radial direction which is perpendicular to a vertical direction by means of the radial repulsion between the inner magnetic ring and the outer magnetic ring;

an upper magnetic ring, which is indirectly fixed to the bottom wall of the inner tub and located on the outer side of the bottom wall of the inner tub;

a flange plate fixed to the bottom wall of the inner tub on the outer side of the bottom wall of the inner tub; and a magnetic floating sleeve fixed to the flange plate on a lower side, facing the bottom wall of the outer tub, of the flange plate, wherein the outer magnetic ring and the upper magnetic ring are both arranged in the magnetic floating sleeve so as to be indirectly fixed to the bottom wall of the inner tub via the magnetic floating sleeve and the flange plate.

2. The laundry device according to claim 1, wherein the outer magnetic ring is configured to be movable in the vertical direction with respect to the inner magnetic ring, so as to increase the area of overlapping-regions between the inner magnetic ring and the outer magnetic ring in the vertical direction, the overlapping-regions having the same magnetism.

3. The laundry device according to claim 1, wherein the upper magnetic ring is opposed to the inner magnetic ring in the vertical direction, and a lower surface of the upper magnetic ring has the same polarity as an upper surface of the inner magnetic ring, so as to support the inner tub in the outer tub in a suspended manner by means of the repulsion between the inner magnetic ring and the upper magnetic ring, and to make the forces of gravity of the inner tub and contents therein directly act on the bottom wall of the outer tub via the inner magnetic ring and the upper magnetic ring.

4. The laundry device according to claim 3, wherein the inner magnetic ring has an inner diameter and an outer diameter that are respectively the same as those of the upper magnetic ring so that projections of the inner magnetic ring and the upper magnetic ring coincide with each other in a horizontal plane.

5. The laundry device according to claim 1, wherein the magnetic floating sleeve is a cylindrical body having a bottom opening; and the upper magnetic ring is arranged at a top wall of the magnetic floating sleeve, and the outer magnetic ring is arranged at a peripheral wall of the magnetic floating sleeve and is located below the upper magnetic ring.

6. The laundry device according to claim 5, further comprising:

a rotating mechanism arranged below the bottom wall of the outer tub, the rotating mechanism having a rotary mandrel extending from below the outer tub into the inner tub to drive the rotation of a pulsator arranged in the inner tub, and a rotary sleeve fitted over the outer side of the rotary mandrel to drive the rotation of the inner tub, wherein the top wall of the magnetic floating sleeve and the flange plate each has a through-hole through which the rotary sleeve can pass, and the through-hole of the top wall of the magnetic floating sleeve is vertically opposed to the through-hole of the flange plate.

7. The laundry device according to claim 6, wherein the inner magnetic ring and the upper magnetic ring each has a central circular hole penetrating in an axial direction thereof; and the inner magnetic ring surrounds a central axial hole of the bottom wall of the outer tub, and the upper magnetic ring surrounds the through-hole of the top wall of the magnetic floating sleeve.

8. The laundry device according to claim 1, wherein the thickness of the inner magnetic ring in the vertical direction is greater than the thickness of the outer magnetic ring in the vertical direction.

9. The laundry device according to claim 1, wherein the outer magnetic ring is arranged opposite the inner magnetic ring on the radially outer side of the inner magnetic ring.

10. The laundry device according to claim 1, wherein at least a portion of the inner magnetic ring is located within a central circular hole of the outer magnetic ring.

* * * * *